US011798522B1

(12) United States Patent
Pereverzev

(10) Patent No.: US 11,798,522 B1
(45) Date of Patent: Oct. 24, 2023

(54) METHOD AND SYSTEM FOR GENERATING MUSICAL NOTATIONS

(71) Applicant: MUSESCORE LIMITED, Limassol (CY)

(72) Inventor: Vasilij Pereverzev, Agiou Spyridonos (CY)

( * ) Notice: Subject to any disclaimer, the term of this patent is extended or adjusted under 35 U.S.C. 154(b) by 0 days.

(21) Appl. No.: 18/056,625

(22) Filed: Nov. 17, 2022

(51) Int. Cl.
*G10G 1/04* (2006.01)
*G10G 3/04* (2006.01)

(52) U.S. Cl.
CPC ..... *G10G 1/04* (2013.01); *G10G 3/04* (2013.01)

(58) Field of Classification Search
CPC ..... G10G 1/04; G10G 3/04
See application file for complete search history.

(56) References Cited

U.S. PATENT DOCUMENTS 4,646,609 A * 3/1987 Teruo ..... G10H 1/0008 984/302
4,655,117 A * 4/1987 Roose ..... G10H 1/20 84/423 B
4,958,551 A * 9/1990 Lui ..... G09B 15/04 84/DIG. 2
5,153,829 A * 10/1992 Furuya ..... G09B 15/002 84/DIG. 12
6,288,315 B1 * 9/2001 Bennett ..... G09B 15/004 84/471 SR
6,740,802 B1 * 5/2004 Browne, Jr. ..... G10H 1/0025 84/622
7,423,213 B2 * 9/2008 Sitrick ..... G09B 15/023 84/645
7,462,772 B2 * 12/2008 Salter ..... G10H 1/0025 84/611
7,750,224 B1 * 7/2010 Rav-Niv ..... G09B 15/00 84/485 R
8,338,684 B2 * 12/2012 Pillhofer ..... G09B 15/00 84/483.2
8,921,677 B1 * 12/2014 Severino ..... G10H 1/0008 84/478
9,082,381 B2 * 7/2015 Barkley ..... G10H 1/0025
9,947,301 B2 * 4/2018 Kelsey ..... G10G 1/04
10,102,767 B2 * 10/2018 Bayadzhan ..... G09B 15/023
11,315,533 B2 * 4/2022 Pace ..... G10G 3/04
2002/0176591 A1 * 11/2002 Sandborn ..... G09B 15/02 84/464 R (Continued)

FOREIGN PATENT DOCUMENTS

GB 2509552 A * 7/2014 ..... G06F 3/04883

*Primary Examiner* — Robert W Horn
(74) *Attorney, Agent, or Firm* — RC Trademark Company

(57) ABSTRACT

Disclosed is a computer-implemented method and system for generating musical notations. The method comprises receiving, via a first input module of a user interface, a musical note, receiving, via a second input module of the user interface, one or more parameters to be associated with the musical note, wherein the one or more parameters comprise at least one of an arrangement context providing information about an event for the musical note, a pitch context providing information about a pitch for the musical note, and an expression context providing information about one or more articulations for the musical note, and generating a notation output based on the entered musical note and the added one or more parameters associated therewith.

13 Claims, 7 Drawing Sheets

(56) References Cited

U.S. PATENT DOCUMENTS

| | | | | |
|---|---|---|---|---|
| 2004/0025668 | A1* | 2/2004 | Jarrett | G10H 1/0066 84/477 R |
| 2009/0114079 | A1* | 5/2009 | Egan | G09B 15/023 84/477 R |
| 2013/0133506 | A1* | 5/2013 | Daisy | G09B 15/00 84/483.2 |
| 2014/0041512 | A1* | 2/2014 | Mastran | G09B 15/023 84/483.2 |
| 2014/0260898 | A1* | 9/2014 | Bales | G10H 1/0008 84/479 A |
| 2017/0243506 | A1* | 8/2017 | Bayadzhan | G09B 15/023 |
| 2020/0066239 | A1* | 2/2020 | Lee | G10G 1/02 |
| 2021/0151017 | A1* | 5/2021 | La | G10H 1/0008 |
| 2023/0089269 | A1* | 3/2023 | Sikangwan | G09B 15/023 |

* cited by examiner

METHOD AND SYSTEM FOR GENERATING MUSICAL NOTATIONS

TECHNICAL FIELD

This present disclosure relates to musical notation systems. In particular, though not exclusively, the present disclosure relates to a method and to a system for generating musical notations.

BACKGROUND

In recent times, technology has played a vital role in rapid development of various industries such as, media, entertainment, music, publishing industry, and other industries. Specifically, with the adoption of new technologies, conventional sheet music has evolved into a digital or paperless format and correspondingly, various sheet music providers have developed various software applications such as, for display, notation or playback of musical score data. Currently, major notation applications use a musical instrument digital interface (MIDI) protocol to provide the musical score notation and playback, wherein MIDI allows for simultaneous provision of multiple notated instructions for numerous instruments. Notably, there are many notated symbols and concepts that can be sufficiently described (in playback terms) using a well-chosen collection of MIDI events. However, there still exist many significant limitations to the said protocol, which severely hamper the playback potential of notation applications based on utilizing MIDI as their primary transmission mode for musical instructions to samplers.

Currently, a wide variety of orchestral samplers and other musical instruments have emerged that provide highly realistic recordings of performance techniques, such as, staccato, legato, etc. However, since MIDI does not include any classification for the such performance techniques, it cannot act as a bridge that automatically connects notation apps to the orchestral samplers.

Further, conventional notation applications have outdated instrument definitions in the General MIDI specification that contains only 128 instrument definitions, which presents multiple problems for any modern notation application. Specifically, the MIDI specification does not comprise various musical instruments and does not support the concept of 'sections' (e.g., a brass section or a string section) and variations for any given instrument. For example, it has a definition for 'clarinet' but does not have any definition of transposing variations thereof (for example, a clarinet in A, piccolo clarinet, a Clarinet in C, etc.). Additionally, since the specification is fixed i.e., not updated, notation applications or sampler manufacturers are unable to amend existing or add any new definitions. Furthermore, due to the lack of notated understanding and insufficient instrument definitions, conventional notation applications cannot provide contextual musical instructions depending on the notation and instrument in question. For example, when a 'slur' mark appears over a sequence of notes on the piano, it is read by the player as an indication of musical phrasing. Moreover, notated symbols such as trills and turns have changed over the centuries and imply different musical performances, depending on the period and country of origin. However, MIDI or General MIDI do not have any inherent flexibility that can solve these problems, and consequently such notation applications and manufacturers thereof are required to sidestep completely in order to arrive at local solutions.

There have been various attempts to solve the aforementioned problems. However, still such solutions face numerous problems such as, but not limited to, the interpretation of articulations and other kinds of unique performance directions that cannot be handled by MIDI instructions are required to be added on a case-by-case basis. Further, since each notation application handles articulations and instrument definitions differently, the approach for how each application translates its unique set of definitions into a recognizable format differs for each application. Moreover, in cases where such solutions support unique playback for a notated symbol, the conventional solutions are forced to fall back on the limited capabilities of MIDI, with each arriving at their own unique method of providing a convincing-sounding performance. However, these fallback performances will not be understood meaningfully by any user (or new comer into music industry) from a notation point of view since the notated concept underpinning the MIDI performance cannot be discerned without dedicated support. Notably, if a newcomer arrived on the scene and tried to establish a similar relationship with each of the notation applications to circumvent the limitations of MIDI, they would be faced with three sub-optimal options, namely, conforming to a set of definitions that matches definitions of an existing notational framework while being potentially limited in their capabilities, since this involves synthesis of musical score playback in a unique manner, or creating separate articulation and instrument definitions in an attempt to convince each of the notation applications to provide them with dedicated support, or conforming to the individual wishes of each of the notation applications, incurring a daunting technical difficulty and time burden.

Therefore, in light of the foregoing discussion, there exists a need to overcome the aforementioned drawbacks and provide a consistent, accurate, dynamic, and virtually universal method and/or a system for generating notations.

SUMMARY OF THE INVENTION

A first aspect of the present disclosure provides a computer-implemented method for generating notations, the method comprising:

- receiving, via a first input module of a user interface, a musical note;
- receiving, via a second input module of the user interface, one or more parameters to be associated with the musical note, wherein the one or more parameters comprise at least one of:
  - an arrangement context providing information about an event for the musical note including at least one of a duration for the musical note, a timestamp for the musical note and a voice layer index for the musical note,
  - a pitch context providing information about a pitch for the musical note including at least one of a pitch class for the musical note, an octave for the musical note and a pitch curve for the musical note, and
  - an expression context providing information about one or more articulations for the musical note including at least one of an articulation map for the musical note, a dynamic type for the musical note and an expression curve for the musical note; and
- generating, via a processing arrangement, a notation output based on the entered musical note and the added one or more parameters associated therewith.

The present disclosure provides a computer-implemented method for generating notations. The term "notation" as used herein refers to music notation (or musical notation), wherein the method or system may be configured to visually represent aurally perceived music, such as, played with instruments or sung by the human voice, via utilization of written, printed, or other symbols. Typically, any user in need of translation of musical data or musical notes may employ the method to generate the required notations, wherein the generated notations are consistent, accurate, and versatile in nature i.e., can be run on any platform or device, and wherein the method provides a flexible mechanism for the user to alter or modify the musical notations based on requirement. It will be appreciated that the method may employ any standard notational frameworks or employ a custom notational framework for generating the notations. Additionally, the method may be configured to provide a flexible playback protocol that allows for articulations to be analyzed from the generated notations.

It should be understood that MIDI functions both as a physical interface (e.g., a cable using 5-pin DIN connectors) and as a protocol for communication over the physical interface. As a protocol, MIDI is very limited as it typically represents musical data events that are not routed in musical notation (e.g., note on, note off, velocity, expression, pitch, etc.). Typically, MIDI comprises a comprehensive list of pitch ranges and allows for multiple signals to be communicated via multiple channels, and enable simultaneous provision of multiple notated instructions for numerous instruments. Beneficially, MIDI has a ubiquitous presence across most music hardware (for example, keyboards, audio interfaces, etc.) and software (for example, DAW's, VST, audio unit plugins, etc.), which enables the method to receive and send complex messages to other applications, instruments and/or samplers and thereby provides versatility to the method. Moreover, MIDI has a sufficient resolution i.e., able to handle precise parameter adjustments in real-time, allowing the method to provide the user with a higher degree and/or granularity of control. Furthermore, MIDI does not sufficiently provide a method for replicating different types of performances based on notation. The embodiments described herein, were developed to get around those limitations with MIDI (e.g., the protocol) as MIDI does not sufficiently replicate different types of musical performances implied by most symbols found in sheet music in a realistic manner. In an exemplary scenario of modern musical notation, there exists a staff (or stave) that consists of 5 parallel horizontal lines which acts as a framework upon which pitches are indicated by placing oval note-heads (i.e., crossing) on the staff lines, between the lines (i.e., in the spaces), or above and below the staff using small additional ledger lines. The notation is typically read from left to right; however, may be notated in a right-to-left manner as well. The pitch of a note may be indicated by the vertical position of the note-head within the staff, and can be modified by accidentals. The duration (note length or note value) may be indicated by the form of the note-head or with the addition of a note-stem plus beams or flags. A stemless hollow oval is a whole note or semibreve, a hollow rectangle or stemless hollow oval with one or two vertical lines on both sides is a double whole note or *breve*. A stemmed hollow oval is a half note or minim. Solid ovals always use stems, and can indicate quarter notes (crotchets) or, with added beams or flags, smaller subdivisions. However, despite such intricate notation standards or frameworks, there still exists a continuous need to develop additional symbols to increase the accuracy and quality of corresponding musical playback and as a result, improve the user experience.

Currently, major notation applications use a musical instrument digital interface (MIDI) protocol to provide a musical score playback. However, there still exist many significant limitations to the said protocol, which severely hamper the playback potential of notation applications based on utilizing MIDI as their primary transmission mode for musical instructions to samplers including, but not limited to, limited definitions (128), absence of concept of sections and variations, immutability, and the like. In light of the aforementioned problems, the present disclosure provides a method for generating notations that are consistent, flexible (or modifiable), versatile, and comprehensive in nature.

The method comprises receiving, via a first input module of a user interface, a musical note. Alternatively stated, the first input module of the user interface may be configured for receiving musical note. For example, a user, employing the method, may be enabled to enter the musical note via the provided first input module of the user interface.

The term "user interface" as used herein refers to a point of interaction and/or communication with a user such as, for enabling access to the user and receiving musical data therefrom. The user interface may configure to receive the musical note either directly from a device or instrument, or in-directly via another device, webpage, or an application configured to enable the user to enter the musical note. Herein, the user interface may be configured to receive, via the first input module, the musical note for further processing thereof. Further, the term "input module" as used herein refers to interactive elements or input controls of the user interface configured to allow the user to provide user input, for example, the musical note, to the method for notation. In an example, the input module includes, but is not limited to, a text field, a checkbox, a list, a list box, a button, a radio button, a toggle, and the like.

Further, the term "musical note" as used herein refers to a sound (i.e., musical data) entered by the user, wherein the musical note may be representative of musical parameters such as, but not limited to, pitch, duration, pitch class, etc. required for musical playback of the musical note. The musical note may be a collection of one or more elements of the musical note, one or more chords, or one or more chord progressions. It will be appreciated that the musical note may be derived directly from any musical instrument, such as, guitar, violin, drums, piano, etc., or transferred upon recording in any conventional music format without any limitations.

The method further comprises receiving, via the user interface, second input module to enable the user to add one or more parameters to be associated with the musical note. Alternatively stated, the user may be enabled to the add one or more parameters associated with the musical note via the second input module of the user interface. The term "parameter" as used herein refers to an aspect, element, or characteristic of the musical note that enables analysis thereof. The one or more parameters are used to provide a context to accurately define the musical note and each of the elements therein to enable the method to provide an accurate notation and further enable corresponding high-quality and precise musical score playbacks. For example, the one or more parameters include, pitch, timber, volume or loudness, duration, texture, velocity, and the like. It will be appreciated that the one or more parameters may be defined based on the needs of the implementation to improve the quality and readability of the notation being generated via the method and the musical score playback thereof.

In an embodiment, upon receiving the musical note from the user, the method further comprises processing the musical note to obtain the one or more pre-defined parameters to be associated with the musical note. Alternatively stated, the musical note, for example, upon being entered by a user via the first input module, is processed to obtain the one or more pre-defined parameters automatically, such that the user may utilize the second input module, to update the pre-defined one or more parameters based on requirement in an efficient manner.

Herein, in the method, the one or more parameters comprise an arrangement context providing information about an event for the musical note including at least one of a duration for the musical note, a timestamp for the musical note and a voice layer index for the musical note. The term "arrangement context" as used herein refers to arrangement information about an event of the musical note required for generating an accurate notation of the musical note via the method. The arrangement context comprises at least one of a duration for the musical note, a timestamp for the musical note and a voice layer index for the musical note. Typically, the musical note comprises of a plurality of events and for each of the plurality of events, the one or more parameters are defined to provide a granular and precise definition of the entire musical note. For example, the event may be one of a note event i.e., where an audible sound is present, or a rest event i.e., no audible sound or a pause is present. Thus, the arrangement context may be provided to accurately define each of the events of the musical note via provision of the duration, the timestamp and the voice layer index of the musical note.

In one or more embodiments, in the arrangement context, the duration for the musical note indicates a time duration of the musical note. The term "duration" refers to the time taken or the time duration for the entire musical note to occur. It will be appreciated that the time duration may be provided for each event of the musical note to provide a granular control via the method. The duration of the musical note may be, for example, in milliseconds (ms), or second (s), or minutes (m), and whereas, the duration of each event may be, for example, in microseconds, ms, or s, to enable identification of the duration of each event (i.e., note event or rest event) of the musical note to be notated and thereby played accordingly. For example, the duration for a first note event may be 2 seconds, whereas the duration of a first rest event may be 50 milliseconds, whereas the duration of the musical note may be 20 seconds. Further, in the arrangement context, the timestamp for the musical note indicates an absolute position of each event of the musical note. The "timestamp" as used herein refers to a sequence of characters or encoded information identifying when a certain event of the musical note occurred (or occurs). In an example, the timestamp may be an absolute timestamp indicating date and time of day accurate to the milliseconds. In another example, the timestamp may be a relative timestamp based on an initiation of the musical note, i.e., the timestamp may have any epoch, can be relative to any arbitrary time, such as the power-on time of a musical system, or to some arbitrary reference time. Furthermore, in the arrangement context, the voice layer index for the musical note provides a value from a range of indexes indicating a placement of the musical note in a voice layer, or a rest in the voice layer. Typically, each musical note may contain multiple voice layers, wherein the musical note events or rest events are placed simultaneously across the multiple voice layers to produce the final musical note (or sound), and thus, a requirement of identification of the location of an event in the multiple musical layers of the musical note may be developed for musical score notation and corresponding playback. Thus, to fulfil such a requirement, the arrangement context contains the voice layer index for the musical note that provides a value from a range of indexes indicating the placement of the musical note event or the rest event in the voice layer. The term "voice layer index" refers to an index indicating placement of an event in a specific voice layer and may be associated with the process of sound layering. The voice layer index may contain a range of values from zero to three i.e., provides four distinct placement indexes, namely, 0, 1, 2, and 3. Beneficially, the voice layer index enables the method to explicitly exclude the musical note events or the rest events, from the areas of articulation or dynamics (which they do not belong to) to provide separate control over each of events of the musical note and the articulation thereof allowing resolution of many musical corner cases.

In one or more embodiments, a pause as the musical note may be represented as a RestEvent having the one or more parameters associated therewith, including the arrangement context with the duration, the timestamp and the voice layer index for the pause as the musical note. Conventionally, MIDI based-solutions do not allow definition of pauses within the musical note into notations and thus, to overcome the aforementioned problem, the method of the present disclosure allows for such pauses to be represented as the RestEvent having the one or more parameters associated therewith. The RestEvent may be associated with the one or more parameters and includes the arrangement context comprising at least the timestamp, the duration, and the voice layer index therein. For example, the arrangement context for a RestEvent may be:—timestamp: 1 m, 10 s; duration: 5 s; and voice layer index:2.

Further, in the method, the one or more parameters comprise a pitch context providing information about a pitch for the musical note including at least one of a pitch class for the musical note, an octave for the musical note and a pitch curve for the musical note. The term "pitch context" refers to information relating to the pitch of the musical note allowing ordering of the musical note on a scale (such as, a frequency scale). Herein, the pitch context includes at least the pitch class, the octave, and the pitch curve of the associated musical note. Beneficially, the pitch context allows determination of the loudness levels and playback requirements of the musical note for enabling an accurate and realistic musical score playback via the generated notations of the method.

In an embodiment, in the pitch context, the pitch class for the musical note indicates a value from a range including C, C #, D, D #, E, F, F #, G, G #, A, A #, B for the musical note. The term "pitch class" refers to a set of pitches that are octaves apart from each other. Alternatively stated, the pitch class contains the pitches of all sounds or musical notes that may be described via the specific pitch, for example, a pitch of any musical that may be referred to as F pitch, is collected together in the pitch class F. The pitch class indicates a value from a range of C, C #, D, D #, E, F, F #, G, G #, A, A #, B and allows a distinct and accurate classification of the pitch of the musical note for accurate notation of the musical note via the method. Further, in the pitch context, the octave for the musical note indicates an integer number representing an octave of the musical note. The term "octave" as used herein refers to an interval between a first pitch and a second pitch having double the frequency as that of the first pitch. The octave may be represented by any whole number ranging from 0-17. For example, the octave may be one of 0, 1, 5, 10, 15, 17, etc. Furthermore, in the pitch context, the pitch curve for the musical note indicates a container of points representing a change of the pitch of the musical note over duration thereof. The term "pitch curve" refers to a graphical curve representative of a container of points or values of the pitch of the musical note over a duration, wherein the pitch curve may be indicative of a change of the pitch of the musical note over the duration. Typically, the pitch curve may be a straight-line indicative of a constant pitch over the duration, or a curved line (such as, a sine curve) indicative of the change in pitch over the duration.

Furthermore, in the method, the one or more parameters comprise an expression context providing information about one or more articulations for the musical note including at least one of an articulation map for the musical note, a dynamic type for the musical note and an expression curve for the musical note. The term "expression context" as used herein refers to information related to articulations and dynamics of the musical note i.e., information required to describe the articulations and applied to the musical note over a time duration, wherein the expression context may be based on a correlation between an impact strength and a loudness level of the musical note in both of the attack and release phases. Typically, the loudness of a musical note depends on the force applied to a resonant material responsible for producing the sound, and thus, for enabling an accurate and realistic determination of corresponding playback data for the musical note, the impact strength and the loudness level are analyzed and thereby utilized to provide the articulation map, the dynamic level, and the expression curve for the musical note. Beneficially, the expression context enables the method to effectively generate an accurate notation capable of enabling further provision of realistic and accurate musical score playbacks. The term "articulation" as used herein refers to a fundamental musical parameter that determines how a musical note or other discrete event may be sounded. For example, tenuto, staccato, legato, etc. The one or more articulations primarily structure the musical note (an event thereof) via describing its starting point, ending point, determining the length or duration of the musical note and the shape of its attack and decay phases. Beneficially, the one or more articulations enable the user to modify the musical note (or event thereof) i.e., modifying the timbre, dynamics, and pitch of the musical note to produce stylistically or technically accurate musical notation to be generated via the method.

Notably, the one or more articulations may be one of single-note articulations or multi-note articulations. In one or more embodiments, the one or more articulations comprise single-note articulations including one or more of: Standard, Staccato, Staccatissimo, Tenuto, Marcato, Accent, SoftAccent, LaissezVibrer, Subito, Fadeln, FadeOut, Harmonic, Mute, Open, Pizzicato, SnapPizzicato, RandomPizzicato, UpBow, DownBow, Detache, Martele, Jete, ColLegno, SulPont, SulTasto, GhostNote, CrossNote, CircleNote, TriangleNote, DiamondNote, Fall, QuickFall, Doit, Plop, Scoop, Bend, SlideOutDown, SlideOutUp, SlidelnAbove, SlidelnBelow, VolumeSwell, Distortion, Overdrive, Slap, Pop.

In one or more embodiments, the one or more articulations comprise multi-note articulations including one or more of: DiscreteGlissando, ContinuousGlissando, Legato, Pedal, Arpeggio, ArpeggioUp, ArpeggioDown, ArpeggioStraightUp, ArpeggioStraightDown, Vibrato, WideVibrato, MoltoVibrato, SenzaVibrato, Tremolo8th, Tremolo16th, Tremolo32nd, Tremolo64th, Trill, TrillBaroque, UpperMordent, LowerMordent, UpperMordentBaroque, LowerMordentBaroque, PrallMordent, MordentWithUpperPrefix, UpMordent, DownMordent, Tremblement, UpPrall, PrallUp, PrallDown, LinePrall, Slide, Turn, InvertedTurn, PreAppoggiatura, PostAppoggiatura, Acciaccatura, TremoloBar.

In one or more embodiments, in the expression context, the articulation map for the musical note provides a relative position as a percentage indicating an absolute position of the musical note. The term "articulation map" refers to a list of all articulations applied to the musical note over a time duration. Typically, the articulation map comprises at least one of the articulation type i.e., the type of articulation applied to (any event of) the musical note, the relative position of each articulation applied to the musical note i.e., a percentage indicative of distance from or to the musical note, and the pitch ranges of the musical note. For example, single note articulations applied to the musical note can be described as: {type: "xyz", from: 0.0, to: 1.0}, wherein 0.0 is indicative of 0% or 'start' and 1.0 is indicative of 100% or end, accordingly. Further, in the expression context, the dynamic type for the musical note indicates a type of dynamic applied over the duration of the musical note. The dynamic type indicates meta-data about the dynamic levels applied over the duration of the musical note and includes a value from an index range: {'pp' or pianissimo, 'p' or piano, 'mp' or mezzo piano, 'mf' or mezzo forte, 'f' or forte, 'ff' or fortissimo, 'sfz' or sforzando}. It will be appreciated that other conventional or custom dynamic types may be utilized by the method without any limitations. Furthermore, in the expression context, the expression curve for the musical note indicates a container of points representing values of an action force associated with the musical note. The term "expression curve" refers to a container of points representing a set of discrete values describing the action force on a resonant material with an accuracy time range measured in microseconds, wherein a higher action force is indicative of higher strength and loudness of the musical note and vice-versa.

In one or more embodiments, the one or more articulations comprise dynamic change articulations providing instructions for changing the dynamic level for the musical note i.e., the dynamic change articulations are configured for changing the dynamic type and thereby the dynamic level applied to the duration of the musical note. Further, the one or more articulations comprise duration change articulations providing instructions for changing the duration of the musical note i.e., the duration change articulations are provided for changing the duration of the articulation application to the musical note or to change the duration of the musical note (or an event thereof). Furthermore, the one or more articulations comprise relation change articulations providing instructions to impose additional context on a relationship between two or more musical notes. Typically, the one or more articulations enable the user to change or modify the musical note by changing the associated expression context thereat. In cases wherein two or more musical notes to be notated and/or played simultaneously or separately, the method allows for additional context to be provided via the relation change articulations that provides instructions for imposing the additional context on the relationship between two or more musical notes. For example, a 'slur' mark placed over a notated sequence for the piano (indicating a phrase), could be given a unique definition due to the instrument being used, which would differ to the definition used if the same notation was specified for the guitar instead (which would indicate a 'hammer-on' performance). In another example, a glissando or arpeggio, as well as ornaments like mordents or trills, could be provided with additional context via the relation change articulations. In yet another example, a marcato can not only signal an additional increase in dynamics on a particular note, but also an additional ⅓ note length shortening in a jazz composition.

In one or more embodiments, the method further comprises receiving, a via a third input module of the user interface, individual profiles for each of the one or more articulations for the musical note, wherein the individual profiles comprise one or more of: a genre of the musical note, an instrument of the musical note, a given era of the musical note, a given author of the musical note. By default, the method comprises built-in general articulations profile for each instrument family (e.g., strings, percussions, keyboards, winds, chorus) that describe the performance technique thereof, including generic articulations (such as, staccato, tenuto, etc.) as well as those specific to instruments such as, woodwinds & brass, strings, percussions, etc. Beneficially, the individual profiles allow the definition and/or creation of separate or individual profiles that can describe any context, including a specific genre, era or even composer. For example, a user may define a jazz individual profile that could specify sounds to produce a performance similar to that of a specific jazz ensemble or style. The term "individual profile" as used herein refers to a set of articulation patterns associated with supported instrument families for defining custom articulation profile i.e., modifiable by a user and comprises information related to the playback of the musical note. Herein, the third input module may be configured to enable the user to define the individual profiles for each of the one or more articulation for the musical note based on a requirement of the user, wherein the individual profiles are defined based on the genre, instrument, era and author of the musical note to provide an accurate notation and corresponding realistic playback of the musical note.

In one or more embodiments, the individual profile may be generated by identifying one or more articulation patterns for the musical note, determining one or more pattern parameters associated with each articulation pattern, wherein the pattern parameter comprises at least one of a time stamp offset, a duration factor, the pitch curve and the expression curve, calculating an average of each of the one or more patterns parameters based on the number of the one or more pattern parameters to determine updated event values for each event of the plurality of events, and altering the one or more performance parameters by utilizing the updated event values for each event. Notably, the individual profile may be capable of serving a number of instrument families simultaneously. For instance, users can specify a single individual profile which would cover all the possible articulations for strings as well as wind instruments. The term "articulation pattern" refers to an entity which contains pattern segments, wherein there may be multiple articulation patterns, if necessary, in order to define the required behavior of multi-note articulations. For example, users can define different behaviors for different notes in an "arpeggio". The boundaries of each segment are determined by the percentage of the total duration of the articulation. Thus, if a note falls within a certain articulation time interval, the corresponding pattern segment may be applied to it. Further, each particular pattern segment of the one or more articulation patterns defines how the musical note should behave once it appears within the articulation scope. Specifically, the definition of the one or more articulation patterns may be based on a number of parameters including, but not limited to, the duration factor, the timestamp offset, the pitch curve and the expression curve, wherein the value of each parameter may be set as a percentage value, to ensure that the pattern is applicable to any type of musical note to provide versatility to the method.

In another embodiment, an expression conveyed by each of the one or more articulations for the musical note depends on the defined individual profile therefor. In other words, the final expression conveyed by each particular articulation of the one or more articulations depends on many factors such as, genre, instrument, particular era or a particular author i.e., depends on the defined individual profile therefor.

The method further comprises generating, via a processing arrangement, a notation output based on the entered musical note and the added one or more parameters associated therewith. The term "notation output" as used herein refers to a musical notation of the musical note entered by the user and thereby generated via the processing arrangement. In an example, the notation output may be associated with the entered musical note and the one or more parameters associated therewith. In another example, the notation output may be a user-defined notation output corresponding to the entered musical note associated with the one or more parameters.

The term "processing arrangement" as used herein refers to a structure and/or module that includes programmable and/or non-programmable components configured to store, process and/or share information and/or signals relating to the method for generating notations. The processing arrangement may be a controller having elements, such as a display, control buttons or joysticks, processors, memory and the like. Typically, the processing arrangement is operable to perform one or more operations for generating notations. In the present examples, the processing arrangement may include components such as memory, a processor, a network adapter and the like, to store, process and/or share information with other computing components, such as, the user interface, a user device, a remote server unit, a database arrangement. Optionally, the processing arrangement includes any arrangement of physical or virtual computational entities capable of enhancing information to perform various computational tasks. Further, it will be appreciated that the processing arrangement may be implemented as a hardware processor and/or plurality of hardware processors operating in a parallel or in a distributed architecture. Optionally, the processing arrangement is supplemented with additional computation system, such as neural networks, and hierarchical clusters of pseudo-analog variable state machines implementing artificial intelligence algorithms. Optionally, the processing arrangement is implemented as a computer program that provides various services (such as database service) to other devices, modules or apparatus. Optionally, the processing arrangement includes, but is not limited to, a microprocessor, a micro-controller, a complex instruction set computing (CISC) microprocessor, a reduced instruction set (RISC) microprocessor, a very long instruction word (VLIW) microprocessor, Field Programmable Gate Array (FPGA) or any other type of processing circuit, for example as aforementioned. Additionally, the processing arrangement may be arranged in various architectures for responding to and processing the instructions for generating the notations via the method.

Herein, the system elements may communicate with each other using a communication interface. The communication interface includes a medium (e.g., a communication channel) through which the system components communicate with each other. Examples of the communication interface include, but are not limited to, a communication channel in a computer cluster, a Local Area Communication channel (LAN), a cellular communication channel, a wireless sensor communication channel (WSN), a cloud communication channel, a Metropolitan Area Communication channel (MAN), and/or the Internet. Optionally, the communication interface comprises one or more of a wired connection, a wireless network, cellular networks such as 2G, 3G, 4G, 5G mobile networks, and a Zigbee connection.

A second aspect of the present disclosure provides a system for generating notations, the system comprising:

a user interface;

first input module to receive, via the user interface, a musical note;

second input module to receive, via the user interface, one or more parameters to be associated with the musical note, wherein the one or more parameters comprise at least one of:

an arrangement context providing information about an event for the musical note including at least one of a duration for the musical note, a timestamp for the musical note and a voice layer index for the musical note, a pitch context providing information about a pitch for the musical note including at least one of a pitch class for the musical note, an octave for the musical note and a pitch curve for the musical note, and an expression context providing information about one or more articulations for the musical note including at least one of an articulation map for the musical note, a dynamic level for the musical note and an expression curve for the musical note; and a processing arrangement configured to generate a notation output based on the entered musical note and the added one or more parameters associated therewith.

In one or more embodiments, in the arrangement context, the duration for the musical note indicates a time duration of the musical note, the timestamp for the musical note indicates an absolute position of the musical note, and the voice layer index for the musical note provides a value from a range of indexes indicating a placement of the musical note in a voice layer, or a rest in the voice layer.

In one or more embodiments, in the pitch context, the pitch class for the musical note indicates a value from a range including C, C #, D, D #, E, F, F #, G, G #, A, A #, B for the musical note, the octave for the musical note indicates an integer number representing an octave of the musical note, and the pitch curve for the musical note indicates a container of points representing a change of the pitch of the musical note over duration thereof.

In one or more embodiments, in the expression context, the articulation map for the musical note provides a relative position as a percentage indicating an absolute position of the musical note, the timestamp for the musical note indicates a time duration of the musical note, and the voice layer index for the musical note provides a value from a range of indexes indicating a placement of the musical note in a voice layer, or a rest in the voice layer.

In one or more embodiments, the one or more articulations comprise:

dynamic change articulations providing instructions for changing the dynamic level for the musical note, duration change articulations providing instructions for changing the duration of the musical note, or relation change articulations providing instructions to impose additional context on a relationship between two or more musical notes.

The present disclosure also provides a computer-readable storage medium comprising instructions which, when executed by a computer, cause the computer to carry out the steps of the method for generating notations. Examples of implementation of the non-transitory computer-readable storage medium include, but is not limited to, Electrically Erasable Programmable Read-Only Memory (EEPROM), Random Access Memory (RAM), Read Only Memory (ROM), Hard Disk Drive (HDD), Flash memory, a Secure Digital (SD) card, Solid-State Drive (SSD), a computer readable storage medium, and/or CPU cache memory. A computer readable storage medium for providing a non-transient memory may include, but is not limited to, an electronic storage device, a magnetic storage device, an optical storage device, an electromagnetic storage device, a semiconductor storage device, or any suitable combination of the foregoing.

Throughout the description and claims of this specification, the words "comprise" and "contain" and variations of the words, for example "comprising" and "comprises", mean "including but not limited to", and do not exclude other components, integers or steps. Moreover, the singular encompasses the plural unless the context otherwise requires: in particular, where the indefinite article is used, the specification is to be understood as contemplating plurality as well as singularity, unless the context requires otherwise.

Preferred features of each aspect of the present disclosure may be as described in connection with any of the other aspects. Within the scope of this application, it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible.

BRIEF DESCRIPTION OF THE DRAWINGS

One or more embodiments of the present disclosure will now be described, by way of example only, with reference to the following diagrams wherein.

DETAILED DESCRIPTION OF THE DRAWINGS

Figure 1:
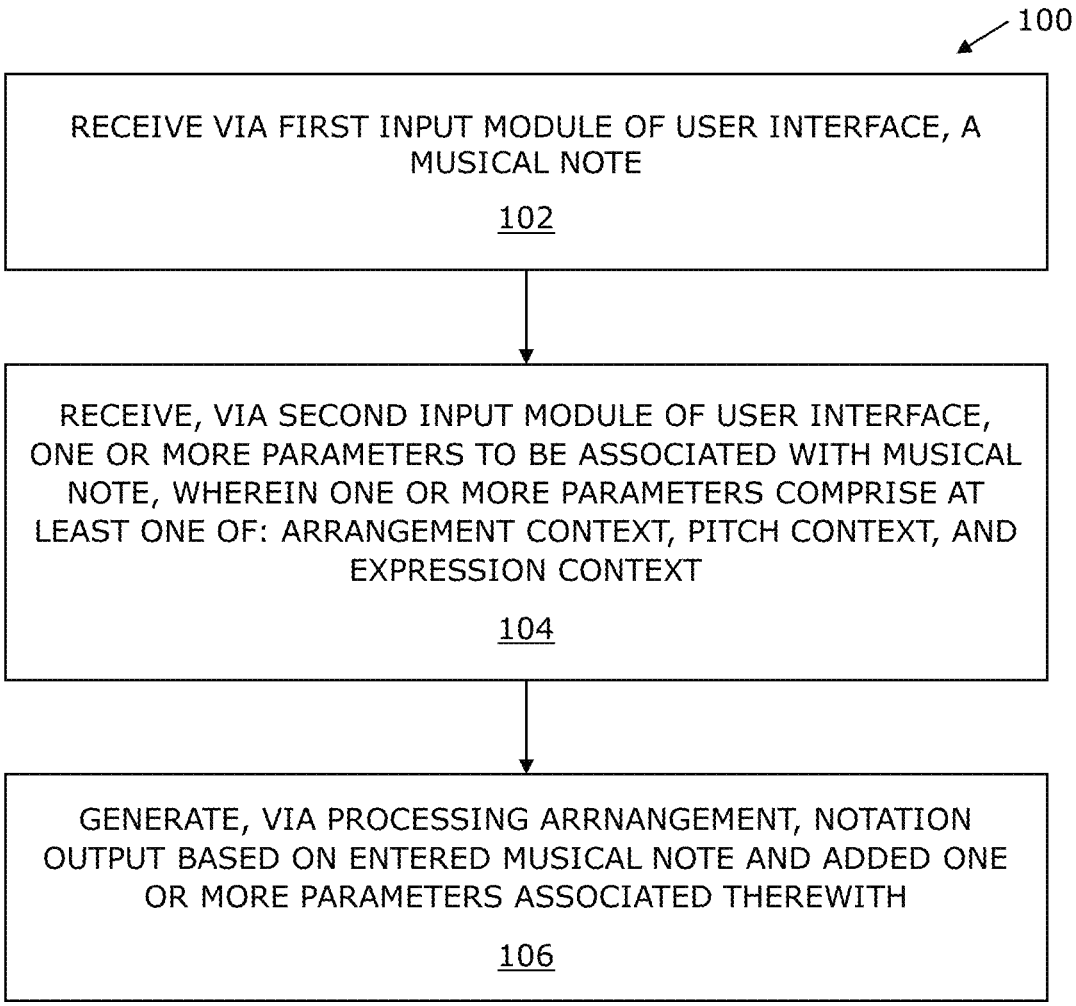
FIG. 1 is an illustration of a flowchart listing steps involved in a computer-implemented method 100 for generating notations, in accordance with an embodiment of the present disclosure.

Referring to FIG. 1, illustrated is a flowchart listing steps involved in a computer-implemented method 100 for generating notations, in accordance with an embodiment of the present disclosure. As shown, the method 100 comprising steps 102, 104, and 106.

At a step 102, the method 100 comprises receiving, via a first input module of a user interface, a musical note. The musical note(s) may be entered by a user via the first input module configured to allow the user to enter the musical note to be translated or notated by the method 100. The musical note may be received from a musical scoring program/software or from a musical instrument (e.g., a keyboard or a guitar). In some embodiments, the musical note may indicate that a musical note is being played without any other data associated with the note.

At a step 104, the method 100 further comprises receiving, via a second input module of the user interface, one or more parameters to be associated with the musical note, wherein the one or more parameters comprise at least one of:

- an arrangement context providing information about an event for the musical note including at least one of a duration for the musical note, a timestamp for the musical note and a voice layer index for the musical note,
- a pitch context providing information about a pitch for the musical note including at least one of a pitch class for the musical note, an octave for the musical note and a pitch curve for the musical note, and
- an expression context providing information about one or more articulations for the musical note including at least one of an articulation map for the musical note, a dynamic type for the musical note and an expression curve for the musical note.

And, at a step 106, the method further comprises generating a notation output, via a processor arrangement, based on the entered musical note and the added one or more parameters associated therewith. Upon addition of one or more parameters via the second input module by the user, the method 100 further comprises generating the notation output based on the one or more parameters.

The steps 102, 104, and 106 are only illustrative and other alternatives can also be provided where one or more steps are added, one or more steps are removed, or one or more steps are provided in a different sequence without departing from the scope of the claims herein.

It should be understood that in some embodiments, the system and method described herein are not associated with the MIDI protocol. The embodiments described herein may function as a replacement for the MIDI protocol. However, the embodiments described herein may be converted to a MIDI protocol MIDI for devices that are only compatible with MIDI.

The generated notation output described herein may be converted to MIDI by removing information that is beyond the scope of conventional MIDI devices.

For example, to convert the protocol associated with the embodiments described herein, durations may be converted to simply Note On/Note Off events. Furthermore, a combination of the pitch and octave contexts may be converted to a MIDI pitch class (e.g. C2, D4, etc.). The velocity measurement described in the present specification records velocity of a note at a far higher resolution than the MIDI protocol so this may be converted down to MIDI velocity range (0-127). Furthermore, (i) rests events and (ii) articulations, such as staccato, pizzicato, arco, mute, palm mute, sul ponticello, snare off, flutter tongue, etc. would be discarded because the MIDI protocol does not support articulations or rest events. In the case of two notes that are tied together, these would have been converted to a single "Note On" and "Note Off" event and slurs/phrase marks would be also be discarded because MIDI doesn't understand them.

Figure 2:
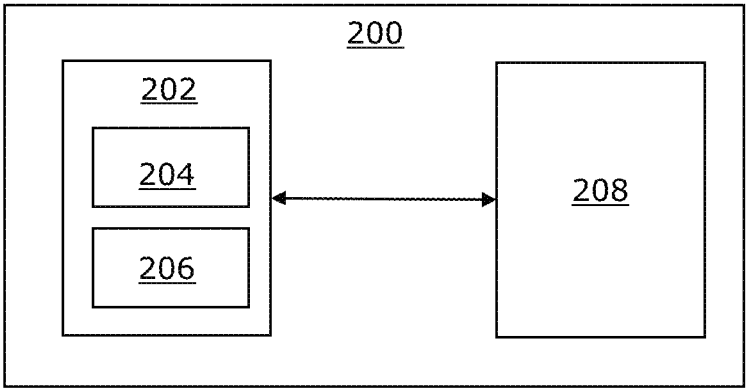
FIG. 2 is an illustration of a block diagram of a system 200 for generating notations, in accordance with another embodiment of the present disclosure.

Referring to FIG. 2, illustrated is a block diagram of a system 200 for generating notations, in accordance with another embodiment of the present disclosure. As shown, the system 200 comprises a user interface 202, a first input module 204, a second input module 206, and a processing arrangement 208. Herein, the first input module 204 may be configured to receive, via the user interface 202, a musical note. The system 200 further comprises a second input module 206 to receive, via the user interface 202, one or more parameters to be associated with the musical note, wherein the one or more parameters comprise at least one of an arrangement context providing information about an event for the musical note including at least one of a duration for the musical note, a timestamp for the musical note and a voice layer index for the musical note, a pitch context providing information about a pitch for the musical note including at least one of a pitch class for the musical note, an octave for the musical note and a pitch curve for the musical note, and an expression context providing information about one or more articulations for the musical note including at least one of an articulation map for the musical note, a dynamic level for the musical note and an expression curve for the musical note. For example, the first input module 204 enables a user to enter the musical note and the second input module 206 enables the user to modify or add the one or more parameters associated therewith. The system 100 further comprises the processing arrangement 208 configured to generate a notation output based on the entered musical note and the added one or more parameters associated therewith.

Figure 3:
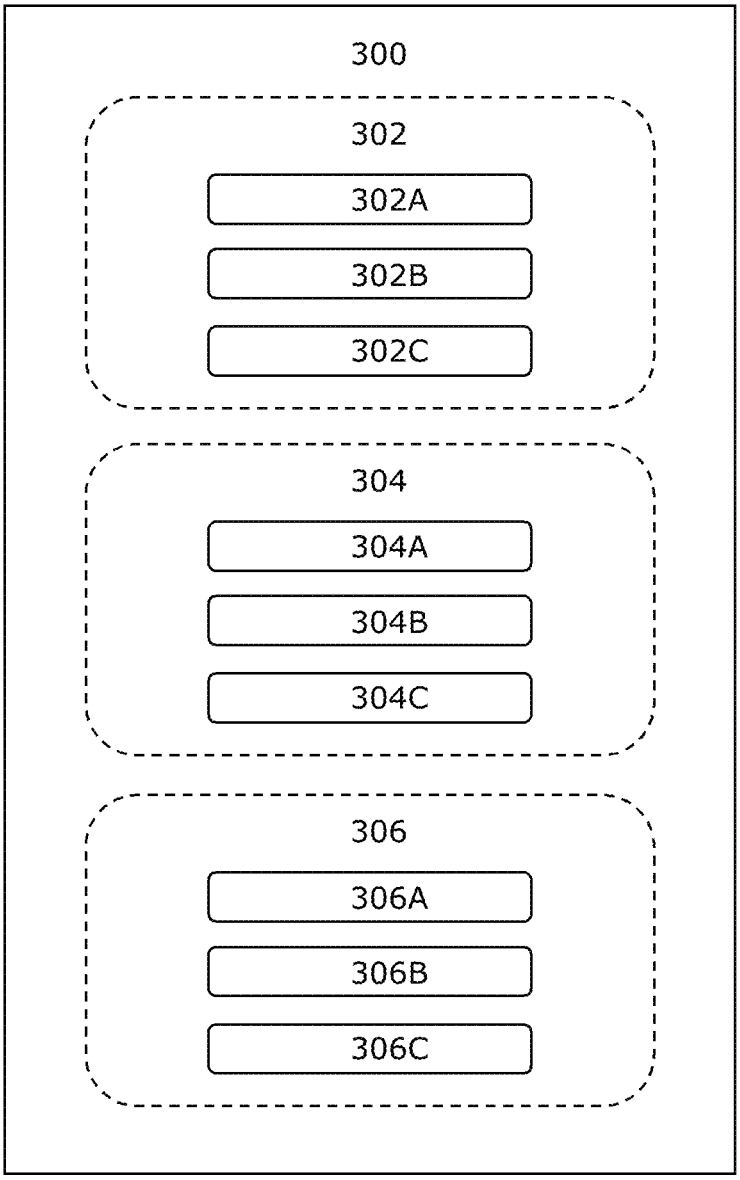
FIG. 3 is an illustration of an exemplary depiction of a musical note using the one or more parameters, in accordance with an embodiment of the present disclosure.

Referring to FIG. 3, illustrated is an exemplary depiction of a musical note using the one or more parameters 300, in accordance with one or more embodiments of the present disclosure. As shown, the exemplary musical note is depicted using the one or more parameters 300 added by the user via the second input module 206 of the user interface 202 i.e., the musical note may be translated using the one or more parameters 300 for further processing and analysis thereof. Herein, the one or more parameters 300 comprises at least an arrangement context 302, wherein the arrangement context 302 comprises a timestamp 302A, a duration 302B and a voice layer index 302C. Further, the one or more parameters 300 comprises a pitch context 304, wherein the pitch context 304 comprises a pitch class 304A, an octave 304B, and a pitch curve 304C. Furthermore, the one or more parameters 300 comprises an expression context 306, wherein the expression context 306 comprises an articulation map 306A, a dynamic type 306B, and an expression curve 306C. Collectively, the arrangement context 302, the pitch context 304, the expression context 306 enable the method 100 or the system 200 to generate accurate and effective notations. In come embodiments, pitch context 304 may comprise (i) a pitch level and (ii) a pitch curve. Pitch level may include an integral value of the pitch, which may be a product of "pitch class" and "octave". This may provide for with various pitch deviations which may not exist in common 12 tone equal temperament tonal system. Furthermore, inverse transformations of a pitch level may be used to determine a pitch class and octave with remaining amount of "tuning" (if it exists). The pitch curve determines a pitch of time and, as such, may comprise a container of points representing a change of the pitch level of the musical note over a duration of time.

Figure 4:
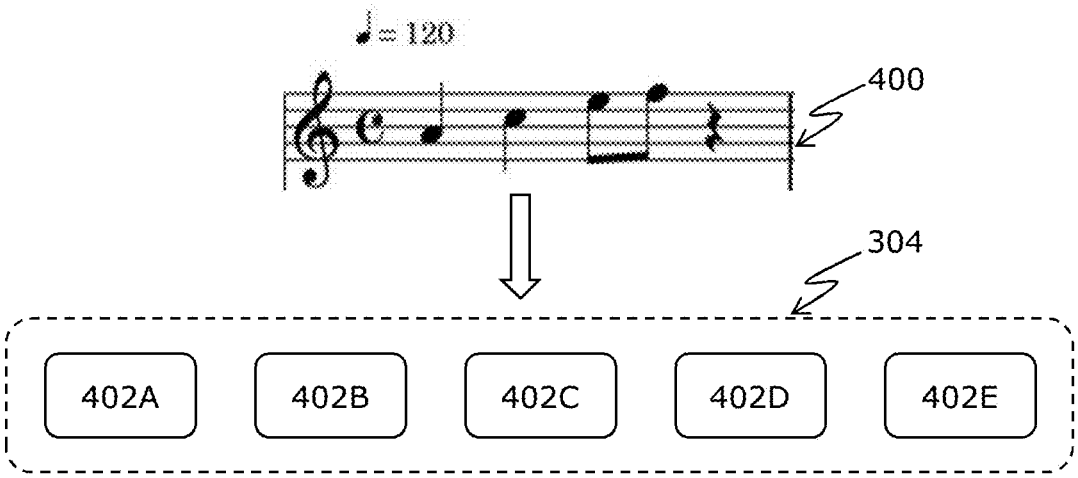
FIG. 4 is an exemplary depiction of a musical note being translated into an arrangement context, in accordance with an embodiment of the present disclosure.

Referring to FIG. 4, illustrated is an exemplary depiction of a musical note 400 being translated into the arrangement context 302, in accordance with an embodiment of the present disclosure. As shown, the musical note 400 comprises a stave and five distinct events or notes that are required to be translated into corresponding arrangement context i.e., the five distinct events of the musical note 400 are represented by the arrangement context 302 further comprising inherent arrangement contexts 402A to 402E. The first musical note is represented as a first arrangement context 402A comprising a timestamp=0 s, a duration=500 ms, and a voice layer index=0. The second musical note is represented as a second arrangement context 402B comprising a timestamp=500 ms, a duration=500 ms, and a voice layer index=0. The third musical note is represented as a third arrangement context 402C comprising a timestamp=1000 ms, a duration=250 ms, and a voice layer index=0. The fourth musical note is represented as a fourth arrangement context 402D comprising a timestamp=1250 s, a duration=250 ms, and a voice layer index=0. The fifth musical note is represented as a fifth arrangement context 402A comprising a timestamp=0 s, a duration=500 ms, and a voice layer index=0.

Figure 5:
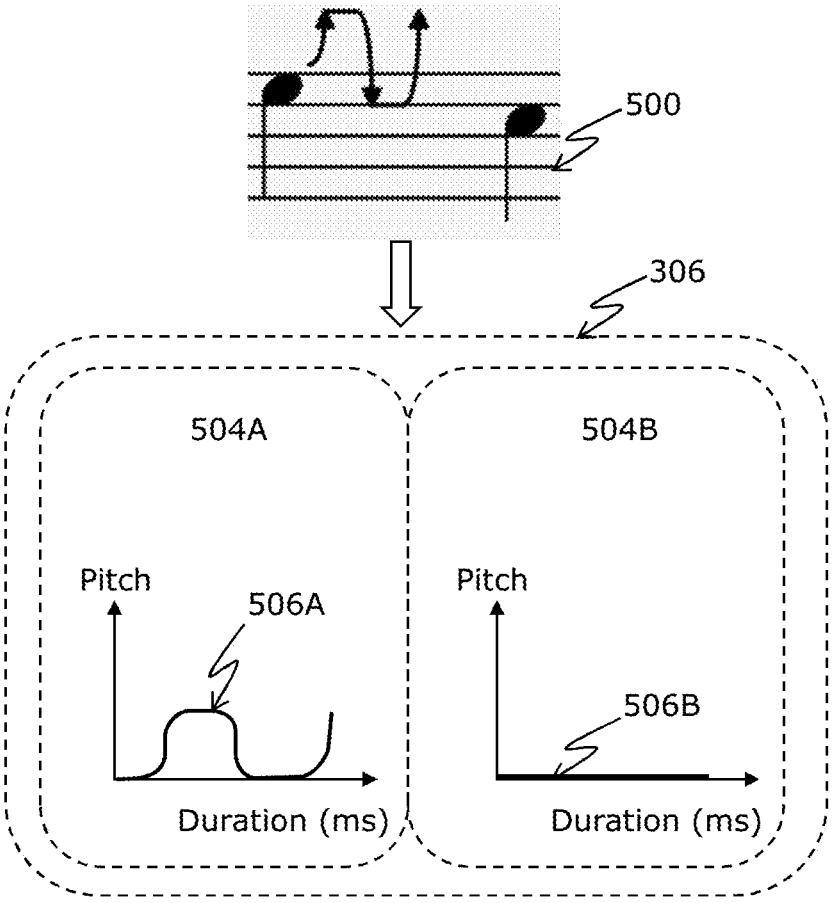
FIG. 5 is an exemplary depiction of a musical note being translated into a pitch context, in accordance with an embodiment of the present disclosure.

Referring to FIG. 5, illustrated is an exemplary depiction of a musical note 500 being translated into the pitch context 304, in accordance with an embodiment of the present disclosure. As shown, the musical note 500 comprises two distinct events or notes that are required to be translated into corresponding pitch context i.e., the two distinct events of the musical note 500 are represented by the pitch contexts 304 further comprising inherent pitch contexts 504A and 504B. The first musical note is represented by the first pitch context 504A, wherein the first pitch context 504A comprises the pitch class=E, the octave=5, and the pitch curve 506A. The second musical note is represented by the second pitch context 504B, wherein the second pitch context 504B comprises the pitch class=C, the octave=5, and the pitch curve 506B.

Figure 6:
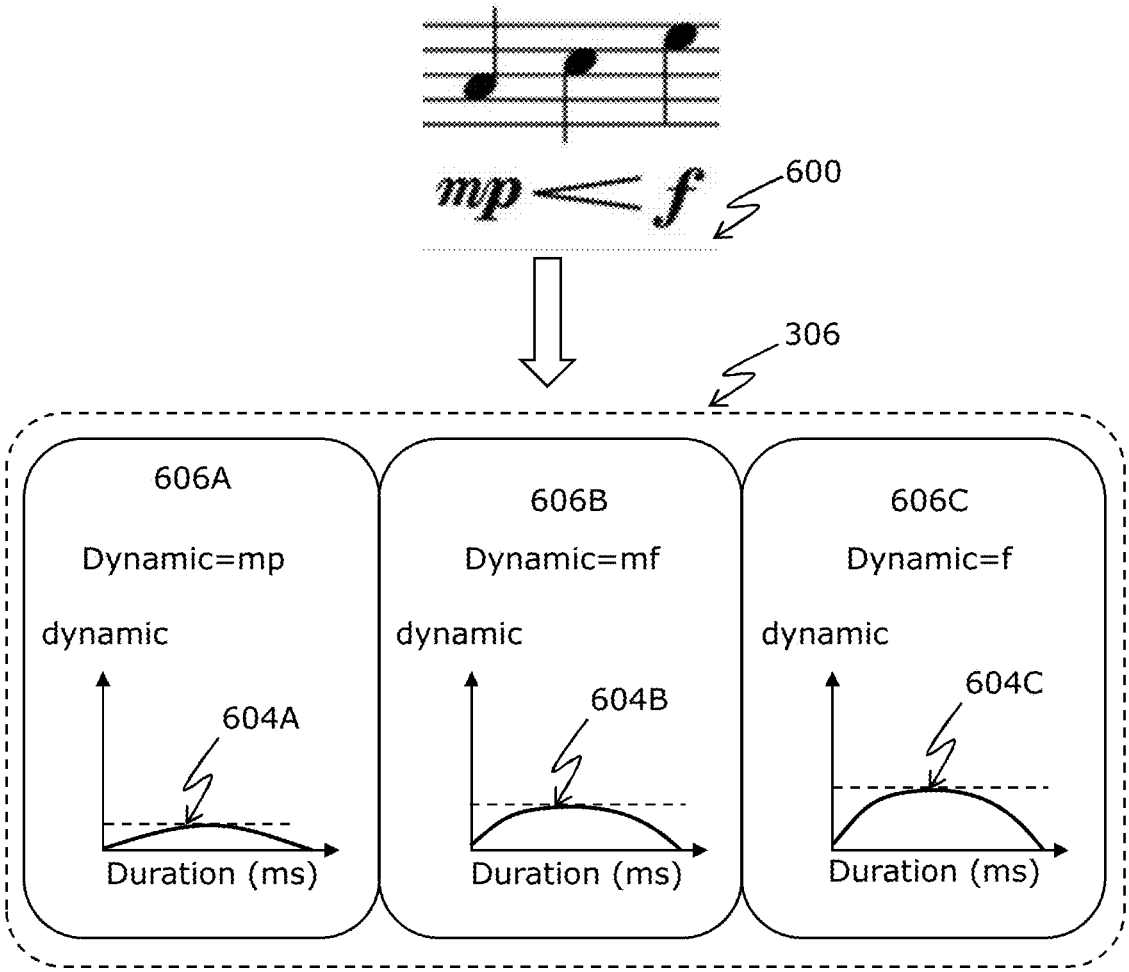
FIG. 6 is an exemplary depiction of a musical note being translated into an expression context, in accordance with an embodiment of the present disclosure.

Referring to FIG. 6, illustrated is an exemplary depiction of a musical note 600 being translated into the expression context 306, in accordance with an embodiment of the present disclosure. As shown, the musical note 500 comprises three distinct events or notes that are required to be translated into corresponding expression context 306 i.e., the three distinct events of the musical note 600 are represented by the expression context 306 further comprising inherent expression contexts 606A to 606C. The first musical note is represented as a first expression context 606A, wherein the first expression context 606A comprises an articulation map (not shown), a dynamic type='mp', and an expression curve 604A. The second musical note is represented as a second expression context 606B, wherein the second expression context 606B comprises an articulation map (not shown), a dynamic type='mf'., and an expression curve 604B. The third musical note is represented as a third expression context 606C, wherein the third expression context 606C comprises an articulation map (not shown), a dynamic type='mf', and an expression curve 604C.

Figure 7A:
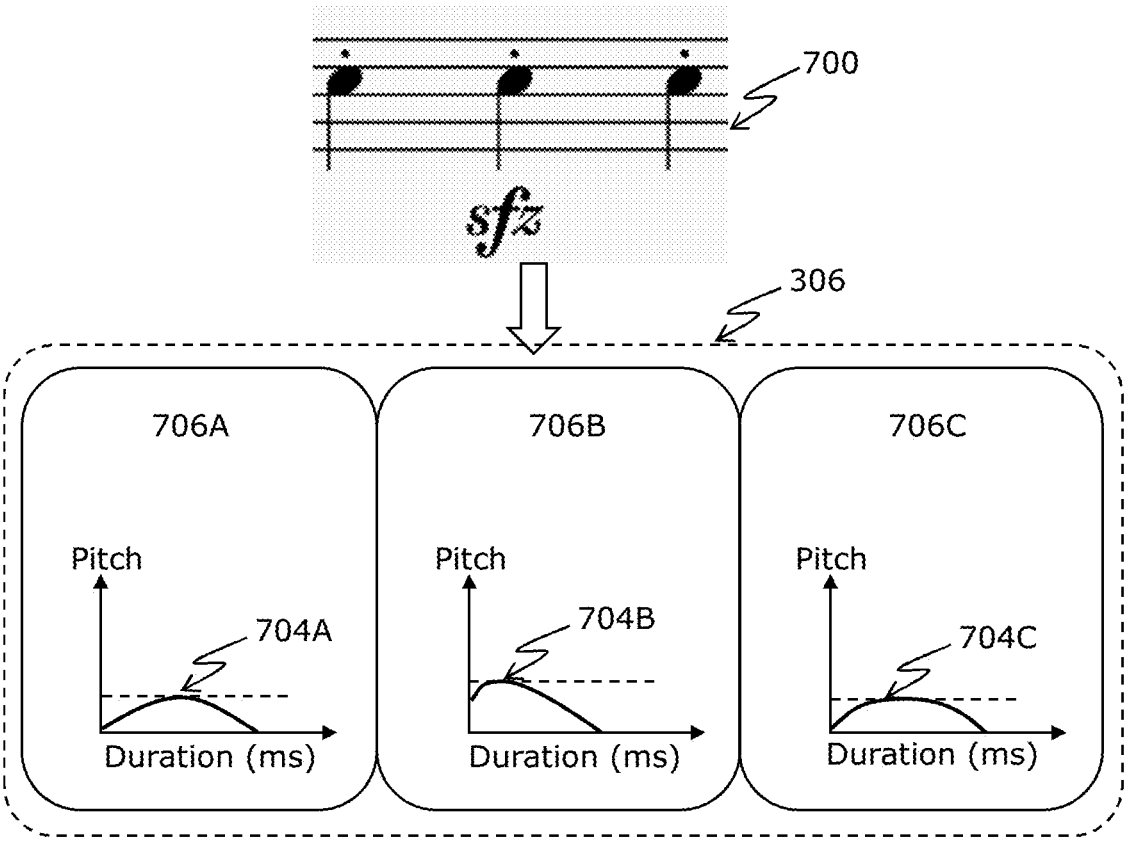
FIG. 7A is an exemplary depiction of a musical note with a sforzando dynamic applied therein, in accordance with an embodiment of the present disclosure.

Referring to FIG. 7A, illustrated is an exemplary depiction of a musical note 700 with a sforzando (sfz) dynamic applied therein, in accordance with some embodiments of the present disclosure. As shown, the musical note 700 comprises three distinct events or notes that are required to be translated into the expression context 306 i.e., the three events are translated into the corresponding expression context 306, with each event or note marked with a "Staccato" articulation and wherein, the second note of the musical note 700 comprises the sforzando (or "subito forzando") dynamic applied therewith, which indicates that the player should suddenly play with force. The first musical note is represented as a first expression context 706A, wherein the first expression context 706A comprises an articulation map (not shown), a dynamic type='natural', and an expression curve 704A and the third musical note is represented as a third expression context 706C, wherein the first expression context 706A is similar to the third expression context 706C. However, the second musical note is represented as a second expression context 706B, wherein the second expression context 706B comprises an articulation map (not shown), a dynamic type='mp', and an expression curve 704B. In this case, the expression curve 704B is short, with a sudden "attack" phase followed by a gradual "release" phase over the duration of the note.

Figure 7B:
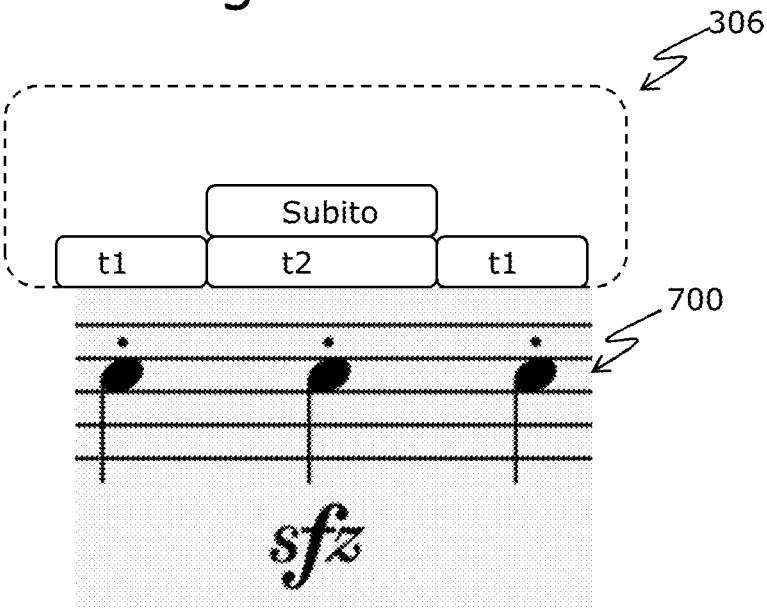
FIG. 7B is an exemplary depiction of the musical note being translated into an expression context, wherein the expression context comprises an articulation map, in accordance with another embodiment of the present disclosure.

Referring to FIG. 7B, illustrated is an exemplary depiction of the musical note 700 being translated into the expression context 306, wherein the expression context 306 comprises an articulation map 702, in accordance with one or more embodiments of the present disclosure. As shown, the articulation map 702 describes the distribution of the one or more articulations; wherein, since all performance instructions are applicable to a single note i.e., the second note of the musical note 700, the timestamp and duration of each particular articulation matches the corresponding notes.

Figure 8:
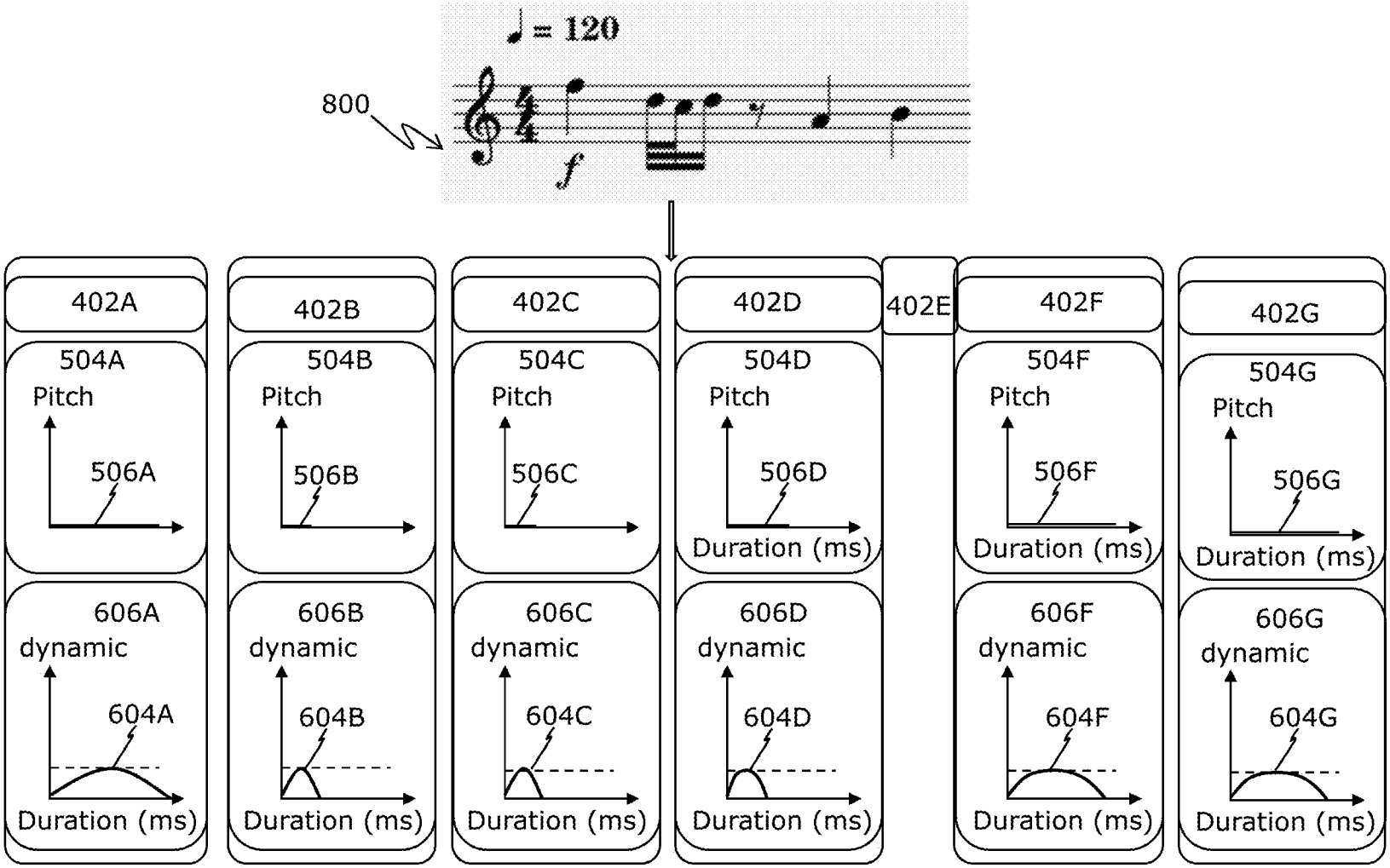
FIG. 8 is an exemplary depiction of a complete translation of a musical note via the method of FIG. 1 or system of FIG. 2, in accordance with one or more embodiments of the present disclosure.

Referring to FIG. 8, illustrated is an exemplary depiction of a complete translation of a musical note 800 via the method 100 or system 200, in accordance with one or more embodiments of the present disclosure. As shown, the musical note 800 comprises seven distinct events i.e., six note events and a rest event. The musical note 800 is expressed or translated in the terms of the one or more parameters 300, wherein each of the six note events comprises respective arrangement context 402X, pitch context 504X, and expression context 606X, X indicates position of an event within the musical note 800, and wherein the rest event comprises only the arrangement context 402E associated therewith. The first event of the musical note 800 i.e., the first note event is expressed by the first arrangement context 402A comprising the time stamp=0 s, duration=500 ms, and voice layer index=0, the first pitch context 504A comprising the pitch class='F', the octave=5, and the pitch curve 506A, and the first expression context 606A comprising the articulation map (not shown), the dynamic type, and the expression curve 604A. Similarly, the second event of the musical note 800 i.e., the second note event is expressed by the second arrangement context 402B comprising the time stamp=0 s, duration=500 ms, and voice layer index=0, the second pitch context 504B comprising the pitch class='D', the octave=5, and the pitch curve 506A, and the second expression context 606A comprising the articulation map (not shown), the dynamic type, and the expression curve 604B. Such a process is followed for each of the events in the musical note 800 except for the rest event i.e., the fifth event of the musical note, wherein only a fifth arrangement context 402E is used for expression of the rest event, wherein the fifth arrangement context 402E comprising the timestamp=750 ms, the duration=250 ms and the voice layer index=0.

Figure 9:
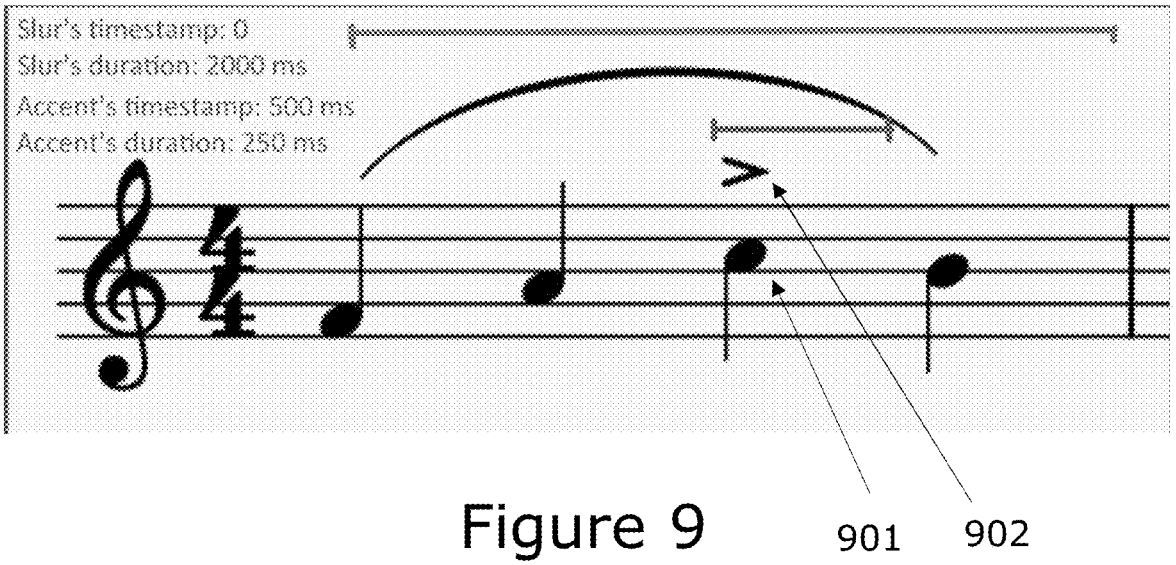
FIG. 9 is an exemplary depiction of a passage of a musical score in accordance with an embodiment of the present disclosure.
Figure 9A:
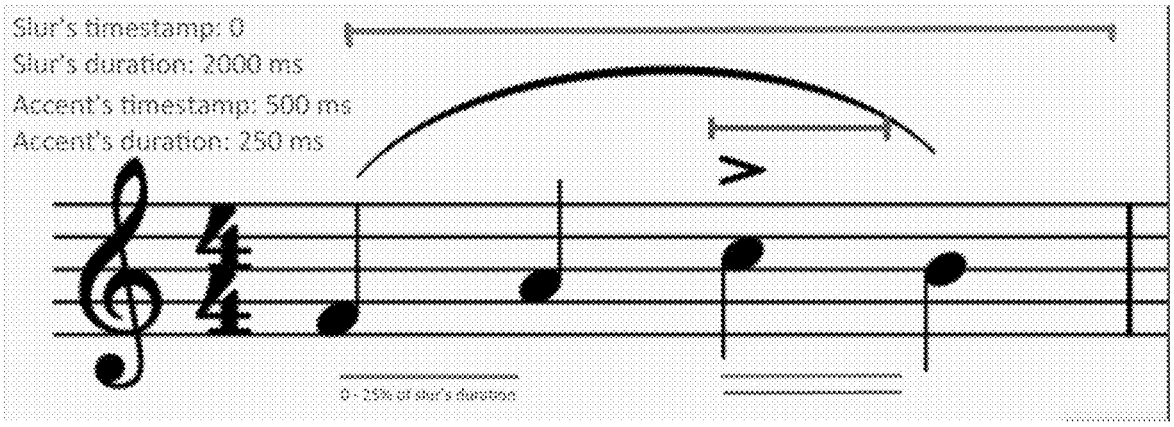
FIG. 9A is an exemplary depiction of a passage of a musical score in accordance with an embodiment of the present disclosure.

For illustrative purposes, and to aid in understanding features of the specification, an example will now be introduced. This example is not intended to limit the scope of the claims. In some embodiments, and referring now to FIG. 9 and FIG. 9A, an example of a music score is illustrated. FIG. 9 and FIG. 9A illustrate a slur. Coding the slur in FIG. 9, a sampler may determine that the first note occupies 25% of the overall duration of the slur. This information allows the sampler to define a phrasing behavior for the slur. Furthermore, a third quarter note 901 "knows" that it's occupies 50-75% of the slur's duration as well as 0-100% of an accent's 902 duration.

This idea of 'multiple articulation' contexts is not known in the art and is not available when using a MIDI protocol. Moreover, articulations may mean different things when combined with various other articulations. For example, a staccato within a phrase mark may be articulated differently depending on the assigned instrument. When playing violin, a staccato note has a very specific sound. For piano, a different sound again. For guitar, it's meaningless and should be ignored.

This written description uses examples to disclose multiple embodiments, including the preferred embodiments, and also to enable any person skilled in the art to practice the invention, including making and using any devices or systems and performing any incorporated methods. Aspects from the various embodiments described, as well as other known equivalents for each such aspects, can be mixed and matched by one of ordinary skill in the art to construct additional embodiments and techniques in accordance with principles of this application.

Those in the art will appreciate that various adaptations and modifications of the above-described embodiments can be configured without departing from the scope and spirit of the claims. Therefore, it is to be understood that the claims may be practiced other than as specifically described herein.

What is claimed:

1. A computer-implemented method for generating notations, the method comprising:

receiving, via a first input module of a user interface, a musical note;

receiving, via a second input module of the user interface, one or more parameters to be associated with the musical note, wherein the one or more parameters comprise at least one of:

an arrangement context providing information about an event for the musical note including at least one of a duration for the musical note, a timestamp for the musical note and a voice layer index for the musical note, a pitch context providing information about a pitch for the musical note including at least one of a pitch class for the musical note, an octave for the musical note and a pitch curve for the musical note, and an expression context providing information about one or more articulations for the musical note including at least one of an articulation map for the musical note, a dynamic type for the musical note and an expression curve for the musical note, wherein, the articulation map for the musical note provides a relative position as a percentage indicating an absolute position of the musical note, the dynamic type for the musical note indicates a type of dynamic applied over the duration of the musical note, the expression curve for the musical note indicates a container of points representing values of an action force associated with the musical note; and generating, via a processor arrangement, a notation output based on the entered musical note and the added one or more parameters associated therewith.

2. The method according to claim 1, wherein, in the arrangement context, the duration for the musical note indicates a time duration of the musical note, the timestamp for the musical note indicates an absolute position of the musical note, and the voice layer index for the musical note provides a value from a range of indexes indicating a placement of the musical note in a voice layer, or a rest in the voice layer.

3. The method according to claim 1, wherein, in the pitch context, the pitch class for the musical note indicates a value from a range including C, C #, D, D #, E, F, F #, G, G #, A, A #, B for the musical note, the octave for the musical note indicates an integer number representing an octave of the musical note, and the pitch curve for the musical note indicates a container of points representing a change of the pitch of the musical note over duration thereof.

4. The method according to claim 1, wherein the one or more articulations comprise:

dynamic change articulations providing instructions for changing the dynamic level for the musical note, duration change articulations providing instructions for changing the duration of the musical note, or relation change articulations providing instructions to impose additional context on a relationship between two or more musical notes.

5. The method according to claim 4 further comprising receiving, via a third input module of the user interface, individual profiles for each of the one or more articulations for the musical note, wherein the individual profiles comprise one or more of: a genre of the musical note, an instrument of the musical note, a given era of the musical note, a given author of the musical note.

6. The method according to claim 5, wherein an expression conveyed by each of the one or more articulations for the musical note depends on the defined individual profile therefor.

7. The method according to claim 1, wherein a pause as the musical note is represented as a RestEvent having the one or more parameters associated therewith, including the arrangement context with the duration, the timestamp and the voice layer index for the pause as the musical note.

8. The method according to claim 1, wherein the one or more articulations comprise single-note articulations including one or more of: Standard, Staccato, Staccatissimo, Tenuto, Marcato, Accent, SoftAccent, LaissezVibrer, Subito, Fadeln, FadeOut, Harmonic, Mute, Open, Pizzicato, SnapPizzicato, RandomPizzicato, UpBow, DownBow, Detache, Martele, Jete, ColLegno, SulPont, SulTasto, GhostNote, CrossNote, CircleNote, TriangleNote, DiamondNote, Fall, QuickFall, Doit, Plop, Scoop, Bend, SlideOutDown, SlideOutUp, SlidelnAbove, SlidelnBelow, VolumeSwell, Distortion, Overdrive, Slap, Pop.

9. The method according to claim 1, wherein the one or more articulations comprise multi-note articulations including one or more of: DiscreteGlissando, ContinuousGlissando, Legato, Pedal, Arpeggio, ArpeggioUp, ArpeggioDown, ArpeggioStraightUp, ArpeggioStraightDown, Vibrato, Wide Vibrato, Mol to Vibrato, SenzaVibrato, Tremolo8th, Tremolo16th, Tremolo32nd, Tremolo64th, Trill, TrillBaroque, UpperMordent, LowerMordent, UpperMordentBaroque, LowerMordentBaroque, PrallMordent, MordentWithUpperPrefix, UpMordent, DownMordent, Tremblement, UpPrall, PrallUp, PrallDown, LinePrall, Slide, Turn, InvertedTum, PreAppoggiatura, PostAppoggiatura, Acciaccatura, TremoloBar.

10. A system for generating notations, the system comprising:

a user interface;

a first input module to receive, via the user interface, a musical note;

a second input module to receive, via the user interface, one or more parameters to be associated with the musical note, wherein the one or more parameters comprise at least one of:

an arrangement context providing information about an event for the musical note including at least one of a duration for the musical note, a timestamp for the musical note and a voice layer index for the musical note, a pitch context providing information about a pitch for the musical note including at least one of a pitch class for the musical note, an octave for the musical note and a pitch curve for the musical note, and an expression context providing information about one or more articulations for the musical note including at least one of an articulation map for the musical note, a dynamic level for the musical note and an expression curve for the musical note, wherein, the articulation map for the musical note provides a relative position as a percentage indicating an absolute position of the musical note, the timestamp for the musical note indicates a duration of the musical note, the voice layer index for the musical note provides a value from a range of indexes indicating a placement of the musical note in a voice layer, or a rest in the voice layer; and a processing arrangement configured to generate a notation output based on the entered musical note and the added one or more parameters associated therewith.

11. The system according to claim 10, wherein, in the arrangement context, the duration for the musical note indicates a time duration of the musical note, the timestamp for the musical note indicates an absolute position of the musical note, and the voice layer index for the musical note provides a value from a range of indexes indicating a placement of the musical note in a voice layer, or a rest in the voice layer.

12. The system according to claim 10, wherein, in the pitch context, the pitch class for the musical note indicates a value from a range including C, C #, D, D #, E, F, F #, G, G #, A, A #, B for the musical note, the octave for the musical note indicates an integer number representing an octave of the musical note, and the pitch curve for the musical note indicates a container of points representing a change of the pitch of the musical note over duration thereof.

13. The system according to claim 10, wherein the one or more articulations comprise:

dynamic change articulations providing instructions for changing the dynamic level for the musical note, duration change articulations providing instructions for changing the duration of the musical note, or relation change articulations providing instructions to impose additional context on a relationship between two or more musical notes.

* * * * *